United States Patent [19]

Dumbaugh

[11] Patent Number: 4,492,629

[45] Date of Patent: Jan. 8, 1985

[54] SIFTER STROKE SCREENING UNIT

[75] Inventor: George D. Dumbaugh, Louisville, Ky.

[73] Assignee: Kinergy Corporation, Louisville, Ky.

[21] Appl. No.: 462,043

[22] Filed: Jan. 28, 1983

[51] Int. Cl.[3] ..... B07B 1/38

[52] U.S. Cl. ..... 209/332; 209/366.5; 198/770

[58] Field of Search ..... 209/365 R, 365 B, 366, 209/367, 366.5, 331, 332, 341, 342; 71/61, 87; 198/770, 762, 752, 766

[56] References Cited

U.S. PATENT DOCUMENTS

| | | | |
|---|---|---|---|
| 1,611,255 | 12/1926 | Sturtevant | 209/341 |
| 2,285,678 | 6/1942 | Overstrom et al. | 209/365.3 |
| 2,874,841 | 2/1959 | Peterson | 209/331 |
| 2,958,228 | 11/1960 | Carrier et al. | 209/365.3 |
| 3,095,747 | 7/1963 | Morris | 209/365.2 |
| 3,498,456 | 3/1970 | Childs et al. | 209/332 |
| 4,287,056 | 9/1981 | Dumbaugh et al. | 209/332 |

FOREIGN PATENT DOCUMENTS

| | | | |
|---|---|---|---|
| 1023303 | 1/1958 | Fed. Rep. of Germany | 209/341 |
| 2252137 | 7/1975 | France | 209/366.5 |
| 854463 | 11/1960 | United Kingdom | 209/341 |

*Primary Examiner*—Frank W. Lutter
*Assistant Examiner*—Wm. Bond
*Attorney, Agent, or Firm*—McWilliams, Mann, Zummer & Sweeney

[57] ABSTRACT

This invention relates to a flat stroke sifter screen unit having the entire vibratory drive system mounted at the inlet end of the unit including drive springs, input motor (or vibratory excitor) and counterbalance, all located at this end of the screening unit. The outlet end of the unit is free of any bearings, or wheels, or rods, or the like and the entire unit is supported on isolation springs which may be steel coils for a fully free floating mounting.

6 Claims, 4 Drawing Figures

LINE STARTER CONTACTS
LINE VOLTAGE 3Ø
VARIABLE AUTO TRANSFORMER OR SCR
10
11
28
29
32
33
34
35
36
37
38
39
42
43
43a
43b
44

SIFTER STROKE SCREENING UNIT

BACKGROUND OF THE INVENTION

1. Field of the Invention

The invention relates to screening apparatus particularly of the vibrating type, driven by an input motor turning eccentric weights combined with sub-resonant tuned "drive" springs.

2. Description of the Prior Art

Screening devices heretofore have been designed to operate horizontally with a gyratory motion intended to distribute material being screened over the major portion of the screening surface and some such devices had bouncing balls, or pellets, that were provided for the purpose of preventing the screen from becoming plugged up by the material. These balls, or pellets, were caused to bounce up-and-down against the screen surface by the vibratory movement of the machine to dislodge any material clogging the screen. Such machines relied more or less upon a "single input" or "brute force" vibratory drive system in order to effect their purpose and therefore consumed an inordinate amount of power to operate and consequently were very expensive to use.

This sifter screen arrangement maintains a sliding relationship of the material over the screen deck whereas prior devices of the linear stroke type, used a pronounced "pitch-and-catch" type of stroke action imparted to the material as it moved over the sifter deck at typical stroke angles of 30°, or greater, from the horizontal. A common conveyor type screening action utilized a 45° stroke angle from the horizontal.

To change the magnitude of the operating stroke of these prior machines, it was necessary to shut the machine down completely and then after the set-up of the eccentric weights to modify the stroke. However, the customers preferred a low power consuming apparatus with a flat stroke action for screening that was readily adjustable both with respect to the stroke and the frequency.

Prior U.S. Pat. No. 4,287,056 of Sept. 1, 1981, provided a Sifter Stroke Screen which had a vibratory flat stroke driven by a squirrel cage motor which afforded a readily adjustable stroke and frequency simply by varying the voltage to the motor. This system of adjusting the sifter operation was disclosed in my prior U.S. Pat. No. 3,251,457 of May 17, 1966. In U.S. Pat. No. 4,287,056 the apparatus included the drive motor with rotating eccentric weights at the inlet end of the sifter but the drive springs, and counterbalance were located at the outlet end of the sifter. Such arrangement was disadvantageous inasmuch as the overall length of the sifter apparatus was increased and resulted in the counterbalance apparatus projecting objectionably at the downstream end of the sifter.

SUMMARY OF THE INVENTION

The present sifter screen arrangement has the entire vibratory drive system mounted at the inlet of the sifter so that not only is the overall length lessened but the projection at the downstream end has been eliminated and by combining all of the elements at the inlet end a considerable amount of installation space is saved.

The vibratory drive system creates motion in a horizontal plane and develops a relatively slight lateral movement as compared to the longitudinal or axial movement, so that a generally elliptical stroke is obtained at the inlet end and this gradually diminishes throughout the extent of the sifter to become a back-and-forth stroke adjacent to the downstream end near the discharge outlet. This type of motion taken with the angular disposition of the sifter maintains a steady and continuous flow of material over the screening media when the sifter is in operation. The angular displacement of the screening decks in the sifter is maintained at an angle of 10°, or less, and normally may be disposed in the range of from zero to about 6° in which range the sifter should operate satisfactorily.

The sifter unit is mounted in a free floating suspension wherein the unit is supported on isolators that allow the sifter to float, free of any restriction. The isolators may comprise steel coil springs, or rubber springs might be utilized if preferred. Normally the sifter unit will operate without the necessity for stabilizers of any kind but, if desired, a form of stabilizer arrangement may be provided for the counterbalance and drive mechanism as an alternative where a customer may specify such installation.

By its compact arrangement the sifter unit is inherently counterbalanced and can be operated at higher frequencies and with a shorter operating stroke than units previously offered on the market and as a result can be better sealed so that less dust is generated by the product and this also affords a more efficient screening action.

DESCRIPTION OF THE DRAWINGS

As described hereinbefore, the invention incorporates the features referred to and which are illustrated in the accompanying drawings wherein.

DESCRIPTION OF PREFERRED EMBODIMENT

Figures 1, 2, 4:
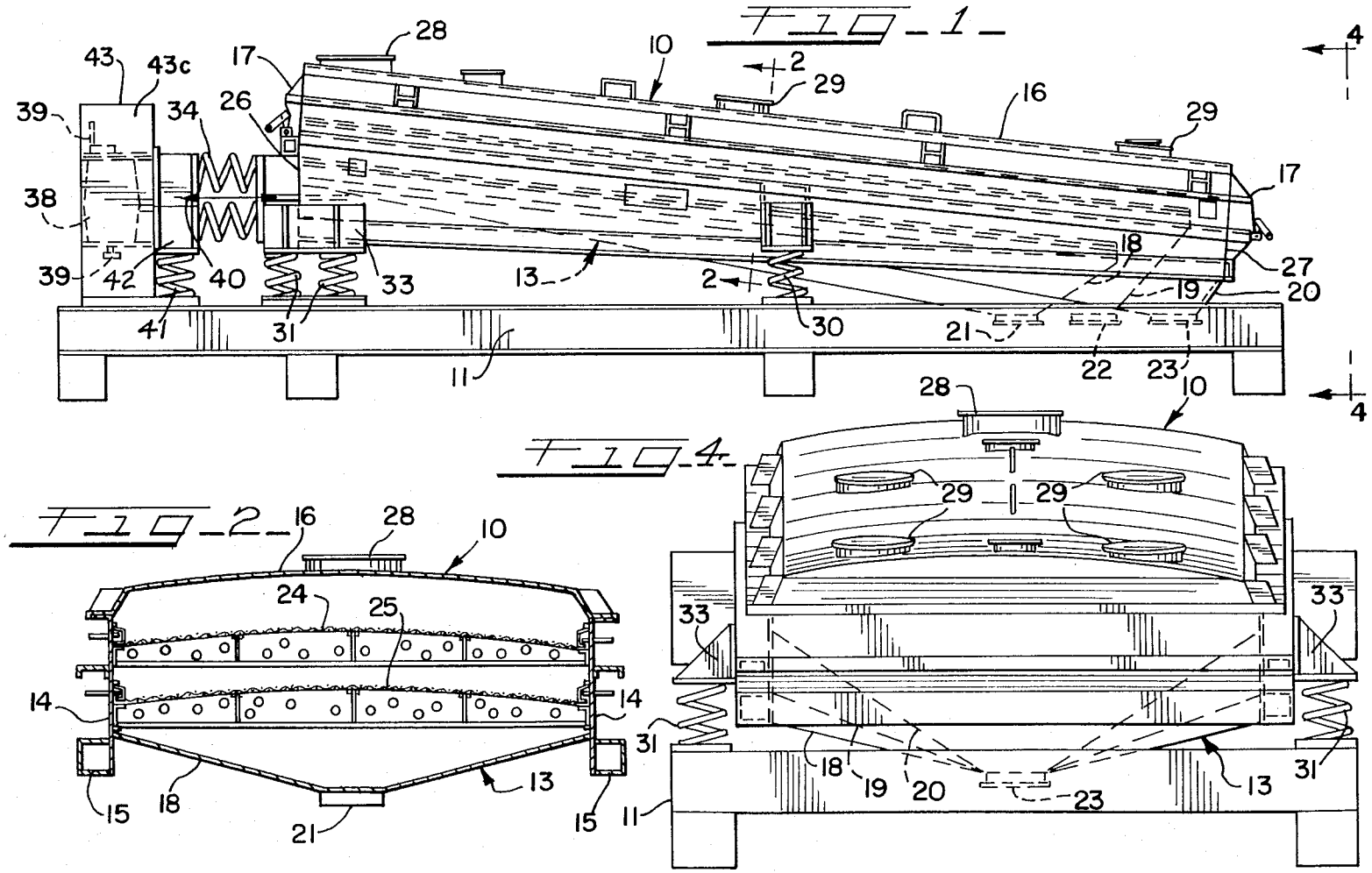
FIG. 1 is a side elevational view of the vibratory sifter screen assembly in accordance with the invention.
FIG. 2 is a transverse cross sectional view through the sifter screen structure taken on the line 2—2 of FIG. 1.
FIG. 4 is an end elevational view of the sifter screen assembly at the downstream end thereof, showing this end completely devoid of any apparatus relating to the driving, or counterbalancing of the unit.

The sifter stroke screening unit of this invention has been designed as an improvement over the sifter stroke screen of U.S. Pat. No. 4,287,056 and offers the important improvement of avoiding the projection of the counterbalance and drive spring assembly beyond the downstream end of the unit by mounting the entire vibratory drive system at the inlet end of the unit. The assembly mounted at the inlet end includes the drive motor, counterbalance and drive springs, which in the prior patent, all except the input motor projected outwardly a considerable amount beyond the outlet end of the sifter frame assembly, so that by locating all of this mechanism at the inlet end of the present unit the projection at the downstream end is eliminated and the improved sifter unit is thus made more compact.

The input motor includes eccentric weights mounted on the vertical motor shaft and when these weights are rotated the sifter screen is caused to move laterally when the eccentrics reach their side positions and then when the weights extend to their longitudinal positions, the steel coil drive springs are excited to move the sifter screen back and forth as the input motor rotates and excites the steel coil drive springs. The input driving force and the spring drive line is essentially horizontal but the screening decks are disposed on an incline that slopes downhill so that with the horizontal sifter stroke action the screen deck develops what might be described as a "shimmy action" that causes the material to move down the deck in a steady stream.

The screening deck in cross section is crowned, with the apex of the crown extending longitudinally along the axial centerline of the screen body which causes the material placed in the unit for screening to spread to both sides of the screen as it enters the sifter unit through an inlet opening located on the axial centerline of the sifter. The sifter unit is fully adjustable with respect to the stroke and as to the frequency both by simple electrical controls through the use of a squirrel cage type of excitor motor with adjustable voltage control.

The screening decks in this sifter unit are disposed at an angle to the horizontal and this angular displacement normally is in the range of from zero to a maximum of about 10° but in some circumstances the angularity is maintained in a range not exceeding 6° from the horizontal. Even though the sifter is mounted at the angularity indicated, the drive system causes the driving motion to be applied in a horizontal plane and imparts a relatively slight lateral movement in relation to its longitudinal movement, which results in a generally elliptical motion adjacent to the inlet end of the sifter unit. This elliptical stroke gradually diminishes as it progresses along the length of the sifter and becomes a direct back-and-forth stroke adjacent to the downstream end of the unit near the discharge outlet.

The sifter screen unit assembly is supported from spaced isolators comprised of steel coil compression springs, although rubber isolators might be utilized if desired. The unit is set atop the isolators or suspended from above by cables from the same isolators, which allow a free floating action of the sifter and no other supporting, or bracing structure is used. The isolators are disposed away from the discharge end of the sifter and this end of the unit is devoid of any appurtenances such as bearings, wheels, rods, or sub-frame, or anything that might affect the operation of the isolators as the sole mounting supports for the sifter assembly.

Because of the concentration of the operating mechanism adjacent to the inlet end this sifter unit requires considerably less input power in its normal operations, which conserves energy and the compactness of the design saves installation space. It also enables the unit to be operated at higher frequencies and with a relatively short stroke as compared to previous units. The design also results in a sifter unit that is inherently counterbalanced which greatly reduces the transmission of high vibratory forces common to other vibrating sifter units.

The assembly of the counterbalance mass, driving springs and drive motor may be stabilized relative to the sifter frame structure by means of a pair of stabilizer or isolator springs, which in view of the projection of this assembly beyond the inlet end of the unit will steady this mechanism for its excessive horizontal action, but with or without this stabilization the sifter unit is highly efficient in its screening action and effective in maintaining a continuous flow of material over the screen deck and is capable of functioning with a minimum of dust resulting from the screening operation.

The primary purpose of this improved sifter screen unit is to maintain a steady flow of material to be screened, over the screening decks and to cause the material to slide continuously down the slope of the screen decks and this operation is enhanced by the angular relationship of the drive system and the disposition of the sifter screen unit whereby the stroke is effected along a horizontal plane and the unit, being sloped downwardly, is caused to have a "shimmy action". This not only is an improvement over the sifter arrangement of U.S. Pat. No. 4,287,056 but represents a great advance over the previous devices that operated in a manner to "pitch-and-catch" products that were typically conveyed at angles of 30° from the horizontal, or greater and some conveyor systems utilize screening actions that operate at a 45° angle from the horizontal.

In the drawings the sifter screen assembly generally represented by the reference character 10 is supported on a base structure 11 which may comprise a structural framework for supporting the unit at any height desired, or directly at floor level but the unit must be left free to vibrate. The sifter screen assembly 10 is in the form of an elongated closed box including a bottom structure 13, side walls 14, which are substantially similar and rise from bottom frame members 15 with a generally curved roof, or top wall 16 mounted on and supported by the side walls. The top wall is removable and is held onto the box structure by clamps 17 which, as shown, are releasable to enable the top wall 16 to be lifted off for maintenance of the screen deck interior.

The floor structure 13 includes three troughs 18, 19 and 20 for fines, middle size and over size screenings respectively and which are discharged through bottom outlets 21, 22 and 23 respectively. The screen decks 24 and 25 are mounted on and supported from the side walls 14 and also from end walls 26 and 27, which complete the box enclosure of the sifter screen assembly. Wall 24 is located at the inlet end of the sifter box and wall 27 is located at the downstream, or outlet end of the box.

Material to be screened is loaded into the sifter screen box through a top loading opening 28 adjacent to the inlet end of the sifter and when the sifter is operated, this material travels lengthwise of the screens 24 and 25 as the assembly is vibrated and because these screen decks are crowned, the material spreads over the full width of the screen decks to obtain a very thorough and effective screening of all of the material. The crowned screen decks are best shown in FIG. 2 and have their peak elevation at the longitudinal center line of the sifter. Access openings 29 are also provided in the top wall 16 for observation of the sifter box interior and the screening operation when the unit is in operation.

The sifter box is mounted for a full free floating action without any restriction, or restraining connections. For this purpose, the sifter box is supported on isolator springs 30 and 31 at both sides of the box. The springs 30 are located approximately midway of the length of the box and are disposed outwardly of the two sides of the box, as best shown in FIG. 4. A gusseted bracket 32 projects outwardly at each side of the box to overlie the springs 30 and thereby support the box at this midpoint on the isolator springs.

The isolator springs 31 are located adjacent to the inlet end of the sifter box and each comprises a set of two springs supporting this end of the box from the base structure 11. Like the springs 30 the spring groups 31 are disposed outwardly of the respective sides of the sifter box and gusseted bracket structures 33 extending outwardly from the opposite sides of the sifter box overlie each of the sets of these springs to support this inlet end of the box on the isolator springs 31. Thus, the sifter box assembly is supported at or near its midpoint and at the inlet end by the four spring sets with the downstream, or discharge end of the box extending cantilever fashion beyond the spring mounts 30, where it is free to vibrate under the influence of excitor means hereinafter to be described. With the sifter box assembly mounted in this manner it floats entirely free on the supporting springs 30 and 31 and is entirely free to vibrate throughout its full length under the impetus of the excitor means without any restraint.

The downstream end of the sifter box assembly is completely devoid of any attachments such as might affect the action of the assembly as operated by the excitor means located at the inlet end of the box. The excitor means for driving the sifter assembly is located adjacent to the inlet end of the assembly together with the drive spring assembly and the counterweight mass, so that nothing of this kind is mounted at the discharge end. The drive spring assembly comprises a group of steel coil springs 34 extending horizontally between the inlet end wall 26 and a counterweight mass 35. A gusseted reinforcing structure 36 is fabricated on the end wall 26 as a back-up for the springs 34 and a similar reinforcing back-up structure 37 is disposed between the drive springs and the counterweight mass 35.

Figure 3:
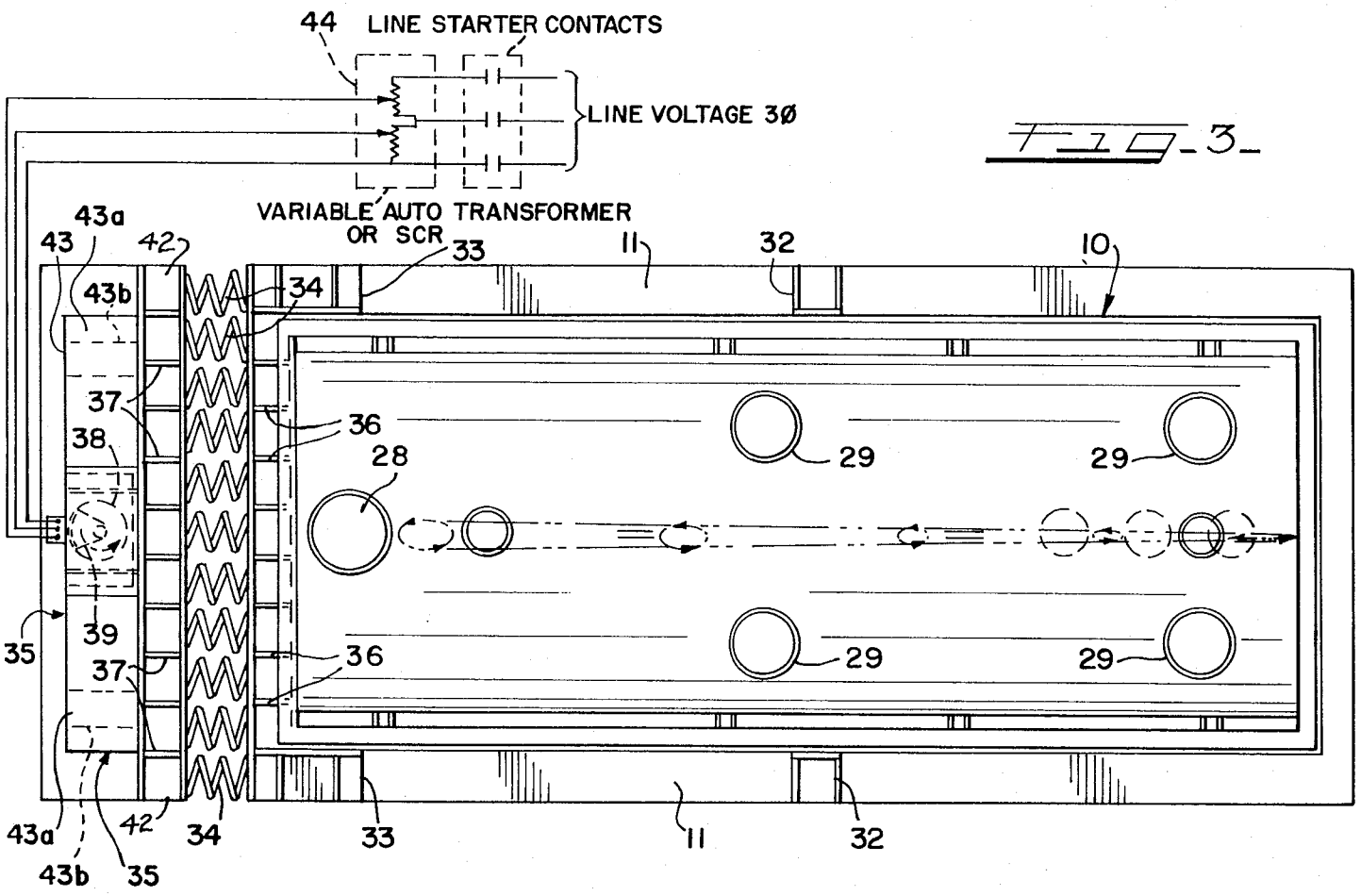
FIG. 3 is a top plan view of the sifter screen assembly showing the entire drive mechanism located at the inlet end of the sifter.

When the drive spring group 34 is excited, they function to drive the sifter box assembly 10 in what can be described as an elliptical vibratory action and which is indicated by phantom diagram in FIG. 3. The drive springs 34 are excited by the counterbalance mass 35 where a rotary excitor motor 38 is mounted on a vertical axis with eccentric weights 39 at top and bottom ends of the motor drive shaft, so that actuation of the motor causes the counterbalance mass to be excited in a horizontal direction and thus excite the drive springs 34 to vibrate the sifter box. The driving force of the springs 34 is primarily horizontal, as indicated by the oppositely extending arrows 40 in FIG. 1. The input motor 38 causes the sifter box assembly 10 to move laterally when the eccentric weights 39 are directed to one side and then, when the weights 39 extend longitudinally, the drive springs 34 are excited to move the sifter box back-and-forth in the longitudinal direction.

As best shown in FIG. 1 the sifter box assembly 10 is sloped downwardly toward the outlet end and with this slope the angular displacement of the screen decks 24 and 25 is maintained at an angle in the range of approximately 0° to a maximum of about 10° and it has been found that the sifting action of the screening decks will continue to be effective if their angularity is maintained within such range with a maximum of about 6°. The drive system causes motion primarily horizontally with a relatively slight lateral motion compared to the extent of the longitudinal movement which results in the elliptical stroke action referred to and this type stroke will gradually diminish as it progresses along the length of the sifter box down the incline until it reaches a point near the outlet end where it becomes a linear or straight back-and-forth stroke at this point. The horizontal sifter stroke action taken with the angular disposition of the screen decks 24 and 25 and the elliptical motion of the stroke results in a somewhat "shimmy" type action of the screens so as to continuously move the material down the incline of the decks.

The horizontal stroke of the counterweight mass 35 with the excitor motor 38 and the drive spring assembly 34 is aided and assisted by supporting the assembly on isolator springs 41 located at respectively opposite sides of the assembly. The springs 41 are engaged at their upper ends by outstanding gusset brackets 42 extending outwardly from the ends of the counterbalance mass 35 and overlying the springs so that the assembly is resiliently supported thereby and caused to be maintained in a horizontal plane throughout 360° of such movement, so that while the entire drive assembly moves both laterally and longitudinally as motivated by the excitor motor 38 the springs 41 stabilize the drive assembly for operation in a horizontal plane while the springs 30 and 31 enable the sifter box assembly to vibrate in the elliptical stroke action hereinbefore described.

As best shown in FIGS. 1 and 3, the counterweight mass 35 comprises the structural assembly including the enclosure wall plates 43, top plate 43$^a$, vertical intermediate plates 43$^b$ and the end wall plates 43$^c$ as well as the bracket structure 42, all floatingly supported on the stabilizing springs 41 as hereinbefore described.

The motor 38 and eccentrics 39 are housed within an enclosure 43 for the safety of personnel who may be around the inlet end of the sifter stroke screening unit when it is in operation. The motor 38 comprises a squirrel cage type of excitor motor with adjustable voltage control, as indicated at 44. This enables the sifter unit to be adjustable both with respect to the stroke and the frequency, by merely varying the voltage to the motor which is obtained merely by utilizing the manually variable autotransformer 44 whereby a fully adjustable rate for the operation of the sifter unit is easily had. The excitor motor can be pulsed with a relatively high voltage to cause the sifter assembly to vibrate at a higher speed and amplitude for brief periods, after which a lower voltage can be applied to obtain a lesser stroke and a lower speed of the sifter apparatus. The lesser stroke and speed referred to probably will be the normal screening stroke used in day-to-day operations.

CONCLUSION

From the foregoing, it will be appreciated that a sifter stroke screening unit has been provided wherein a horizontal stroke driving motion has been combined with an angularly disposed sifter unit wherein the sifter unit is mounted on vertical steel coil isolator springs independently of a counterbalance mass which is also supported on vertically arranged steel coil isolator springs and other steel coil springs are horizontally disposed between the sifter unit and the counterbalance mass to transmit such driving motion and wherein all of the driving mechanism is located at the inlet end of the sifter unit.

What is claimed is:

1. A vibratory sifter screen unit including a sifter trough and screen structure having an inlet end and an outlet end downstream from the inlet, spaced apart spring isolators supporting the sifter trough and screen structure for free floating motion laterally and axially said outlet end being unsupported for free motion, said screen structure having a crown with its apex extending longitudinally on the axial center line of the screen structure, a vibratory drive assembly mounted on the structure at the inlet end, said assembly comprising a rotary motor and counterbalance mass mounted in spaced relation ahead of said inlet end on the longitudinal center line of the screen unit, springs supporting said assembly independently of the sifter trough and screen structure, and steel coil drive springs providing an operative connection between said assembly and the inlet end of the sifter screen unit and comprising the only driving connection therebetween, said motor having an eccentric weight imparting a generally elliptical vibratory motion to the unit adjacent the inlet end and exciting said drive springs to develop vibratory motion axially or linearly of the unit, said vibratory motion initially developing the generally elliptical motion of the sifter screen adjacent to the inlet end and diminishing gradually along the length of the sifter screen to a straight linear, axial motion adjacent to the outlet end of the screen structure.

2. The vibrating sifter screen as set forth in claim 1 wherein said screen structure is disposed at an angle within the range of 0° to about 10°.

3. The vibratory sifter screen unit as set forth in claim 2 wherein said angle is maintained in a range not exceeding about 6°.

4. The vibratory sifter screen unit as set forth in claim 2 wherein said motor and eccentric weight drives said generally elliptical vibratory motion in a substantially horizontal plane at an acute angle to the normal operating position of the sifter screen structure.

5. A vibratory sifter unit as set forth in claim 1 wherein said crown is arched laterally from its apex causing material deposited on the screen structure to spread to both sides of the screen structure upon vibratory movements thereof and thence to said outlet end.

6. A vibratory sifter screen unit including a sifter trough and screen structure having an inlet end and an outlet end and supported on a plurality of vertically disposed steel coil springs said outlet end being unsupported for free motion, an excitor assembly including a counterbalance mass and a driving motor supported by means of a plurality of vertical steel coil springs independently of said sifter trough and screen structure, and horizontally disposed steel coil springs comprising the only driving connection between said counterbalance mass and said sifter trough and screen structure, said assembly and driving motor being positioned ahead of said inlet end on the longitudinal center line of the screen unit.

* * * * *